US010794184B2

(12) United States Patent
Sun et al.

(10) Patent No.: US 10,794,184 B2
(45) Date of Patent: Oct. 6, 2020

(54) RECYCLABLE SAND-CONSOLIDATED ANCHOR HEAD PRESTRESSED ANCHOR, ANCHORAGE JACK AND ITS APPLICATION METHOD

(71) Applicants: INSTITUTE OF ROCK AND SOIL MECHANICS, CHINESE ACADEMY OF SCIENCES, Wuhan (CN); Sanming Road and Bridge Group Co. Ltd., Sanming (CN); Guangxi Beitou Transportation Maintenance Technology Group Co., Ltd., Nanning (CN); Foshan Sanlongwan Urban Construction Co. Ltd., Foshan (CN)

(72) Inventors: Guanhua Sun, Wuhan (CN); Yinghao Sun, Wuhan (CN); Shan Lin, Wuhan (CN); Yongtao Yang, Wuhan (CN); Hong Zheng, Wuhan (CN); Chunguang Li, Wuhan (CN); Fuxing Liao, Sanming (CN); Junhui Luo, Nanning (CN); Qinglin Chen, Nanning (CN); Yi Xiong, Foshan (CN)

(73) Assignees: INSTITUTE OF ROCK AND SOIL MECHANICS, CHINESE ACADEMY OF SCIENCES, Wuhan (CN); Sanming Road and Bridge Group Co. Ltd., Sanming (CN); Guangxi Beitou Transportation Maintenance Technology Group Co., Ltd., Nanning (CN); Foshan Sanlongwan Urban Construction Co. Ltd., Foshan (CN)

( * ) Notice: Subject to any disclaimer, the term of this patent is extended or adjusted under 35 U.S.C. 154(b) by 0 days.

(21) Appl. No.: 16/519,017

(22) Filed: Jul. 23, 2019

(65) Prior Publication Data

US 2020/0102826 A1 Apr. 2, 2020

(30) Foreign Application Priority Data

Sep. 30, 2018 (CN) ..... 2018 1 1156862

(51) Int. Cl.
*E21D 21/00* (2006.01)
*E02D 5/74* (2006.01)
*E21D 20/00* (2006.01)

(52) U.S. Cl.
CPC ..... *E21D 21/0026* (2013.01); *E02D 5/74* (2013.01); *E21D 20/00* (2013.01); (Continued)

(58) Field of Classification Search
CPC ..... E21D 20/00; E21D 21/00
See application file for complete search history.

(56) References Cited

FOREIGN PATENT DOCUMENTS

CN 1456790 * 11/2003

OTHER PUBLICATIONS

Machine Translation of CN 1456790, 6 pages (Year: 2003).*

* cited by examiner

*Primary Examiner* — Sunil Singh
(74) *Attorney, Agent, or Firm* — Platinum Intellectual Property LLP

(57) ABSTRACT

The invention discloses a retrievable sand consolidation anchor head prestressed anchor rod, an anchoring jack and an application method thereof, and belongs to the technical field of geotechnical engineering. The retrievable sand-consolidated anchor head pre-stressed anchor includes a bolt body 6, a rigid frame 5, a load member 1, a sand column 2, a pressure receiving member 4, a cut-off member 3, and an anchor pier 8. The anchoring jack includes a force transmitting frame 12, a first guiding plate 25, a second guiding plate 28, and a housing 13. The application method includes an anchoring method using the retrievable sand-consoli- (Continued)

dated anchor head prestressed anchor rod and a method of recovering the retrievable sand-consolidated anchor head pre-stressed anchor rod. After the anchoring of the reclaimed sand-consolidated anchor head pre-stressed anchor rod, the bolt body can be recovered and reused, and the operation is simpler and more environmentally friendly.

5 Claims, 3 Drawing Sheets

(52) U.S. Cl.
CPC ..... *E21D 21/0033* (2013.01); *E21D 21/0086* (2013.01); *E02D 2250/0046* (2013.01)

RECYCLABLE SAND-CONSOLIDATED ANCHOR HEAD PRESTRESSED ANCHOR, ANCHORAGE JACK AND ITS APPLICATION METHOD

RELATED APPLICATIONS

This application is a Non-provisional Application under 35 USC 111(a), which claims Chinese Patent Application Serial No. CN201811156862.8, filed Sep. 30, 2018, the disclosure of all of which are hereby incorporated by reference in their entirety.

TECHNICAL FIELD

The invention relates to the technical field of geotechnical engineering, in particular to a pre-stressed anchor rod for reclaiming sand-consolidated anchor head, a jack for anchoring and an application method thereof.

BACKGROUND TECHNIQUE

Geotechnical engineering is a civil engineering project that uses rock and soil as a working object and involves the utilization, remediation and transformation of rock and soil. The anchoring technology of geotechnical engineering is the main technical measure of anchor spray support, which effectively controls the stability of rock and soil in the utilization, remediation and transformation of rock and soil. Geotechnical engineering anchoring technology widely applies thousands of mines, wells, traffic tunnels and urban subways, underground water conservancy and hydropower plants and tunnels, slopes and dam foundations, as well as defense and civil air defense projects. As a kind of support, the bolt body support is fundamentally different from the traditional support method. The traditional support method is often passively subjected to the load generated by the collapsed rock mass, and the anchor body can actively reinforce the rock and soil. Body, effectively controlling its deformation and preventing the occurrence of collapse. The bolt body support is mainly improved in structure, material and construction technology, and is developed to be reasonably loaded, fast bearing, adaptable and efficient, to meet the needs of engineering construction in a weak and fractured geological environment. Sand-consolidation anchor head prestressed anchor is a new anchoring technology that has emerged in recent years. It utilizes the expansion of sand during compression to create a large frictional force on the surface of the rock wall and the anchor body to provide anchoring force.

SUMMARY OF THE INVENTION

In view of this, the present invention provides a reclaimable sand-consolidation anchor head prestressed anchor rod, anchoring jack and application method thereof, and after being anchored, the bolt body can be recovered, reused, and operated. It's simpler and more environmentally friendly, making it more practical.

In order to achieve the above first object, the technical solution of the reclaimable sand-consolidation anchor head prestressed anchor provided by the present invention is as follows:

The reclaimable sand consolidation anchor head prestressed anchor provided by the invention comprises a bolt body (6), a rigid frame (5), a load member (1), a sand column (2), a pressure bearing member (4), and a cut-off Piece (3) and anchor pier (8), One end of the rigid frame (5) is fixedly connected to one surface of the pressure receiving member (4), and the other end of the rigid frame (5) is fixedly connected to one surface of the anchor pier (8), One surface of the pressure receiving member (4) corresponds to one surface of the anchor pier (8) such that the spacing between the pressure receiving member (4) and the anchor pier (8) is made by the rigid frame (5) fixed;

a first through hole (18) is opened in a center of the pressure receiving member (4), the cutoff member (3) can be accommodated in the first through hole (18), and the cutoff member (3)) can only move in one direction along the axial direction of the pressure receiving member (4);

a second through hole (15) is defined in a center of the load member (1), a third through hole (16) is defined in a center of the sand column (2), and a center of the cutoff member (3) is opened a through hole (17), a center of the anchor pier (8) is provided with a fifth through hole (23), the second through hole (15), the third through hole (16), and the fourth through hole (17) And the fifth through hole (23) is concentric;

The anchor body (6) can sequentially slide with the outer walls of the second through hole (15), the third through hole (16), the fourth through hole (17), and the fifth through hole (23) vice;

The diameters of the load member (1), the sand column (2), the pressure bearing member (4), and the rigid frame (5) are all equivalent to the diameter of the anchoring bore (7), and the radial direction of the anchor pier (8) The size is larger than the diameter of the anchoring bore (7);

One end (22) of the anchor body (6) is a polished rod, and the bolt body (6) is sequentially passed through the light rod to the second through hole (15) and the third through hole (16). After the fourth through hole (17) and the fifth through hole (23), the other end of the anchor body (6) protrudes from the fifth through hole (23).

The reclaimable sand-consolidated anchor head prestressed anchor provided by the invention can be further realized by the following technical measures.

Preferably, the retrievable sand-consolidated anchor head prestressed anchor further comprises a carrier plate (9), The center of the carrier plate (9) is provided with a sixth through hole (24).

The anchor body (6) can form a sliding pair with the inner wall of the sixth through hole (24);

When the bolt body (6) is sequentially passed through the light rod, the second through hole (15), the third through hole (16), the fourth through hole (17), and the fifth through hole (23) And after the sixth through hole (24), the other end of the anchor body (6) protrudes from the fifth through hole (23).

Preferably, the retrievable sand-consolidated anchor head pre-stressed anchor further comprises a first lock nut (10), The other end (21) of the anchor body (6) is provided with an external thread.

The first lock nut (10) is capable of locking the external thread.

Preferably, one end (22) of the anchor body (6) is provided with a damping member.

Preferably, the inner wall of the second through hole (15), the fourth through hole (17) and the fifth through hole (23) are provided with a damping member.

Preferably, the inner wall of the sixth through hole (24) is provided with a damping member.

Preferably, the load member (1), the cut-off member (3) and the anchor body (6) are both magnetic, wherein the magnetic poles of the load member (1) and the cut-off member (3) are the same, the anchor rod The magnetic pole of the body (6) is opposite to the magnetic poles of the load member (1) and the cut-off member (3).

Preferably,

The first through hole (18) is a tapered hole, and the diameter of the tapered hole toward one end of the anchor body (6) is smaller than the tapered end toward the other end of the anchor body (6) diameter of;

The cut-off member (3) is tapered.

The outer tapered surface (19) of the shutoff member (3) is in full contact with the inner tapered surface (20) of the tapered bore.

Preferably, the outer tapered surface (19) and the inner tapered surface (20) are each provided with a damping member.

Preferably, the damper member is made of a material having a pressure variability.

Preferably, the pressure-deformable material is rubber or latex.

Preferably, the pressure receiving member (4) and the shutoff member (3) are both magnetic and opposite in magnetic properties.

In order to achieve the above second object, the technical solution of the anchor jack provided by the present invention is as follows:

The anchor for anchoring provided by the present invention comprises a force transmitting frame (12), a first guiding plate (25), a second guiding plate (28) and a casing (13).

One end of the force transmitting frame (12) is fixedly connected to the first guiding plate (25), and the other end of the force transmitting frame (12) is used for abutting the recyclable sand consolidation according to claim 1. Anchor pier (8) of anchor head prestressed anchor or load-bearing plate (9) of reclaimable sand-consolidated anchor head pre-stressed anchor according to claim 2;

a seventh through hole (26) is defined in a center of the first guiding plate (25), and an eighth through hole (27) is opened in a center of the second guiding plate (28), and the seventh through hole (26) The eighth through hole (27) is concentric with the second through hole (15), the third through hole (16), the fourth through hole (17), and the fifth through hole (23).

One end of the housing (13) is fixedly connected to the first guiding plate (25) through an edge thereof, and the other end of the housing (13) is fixedly connected to the second guiding plate (28) through an edge thereof A cavity (29) is formed between the first guiding plate (25), the second guiding plate (28) and the casing (13).

The anchoring jack provided by the present invention can be further realized by the following technical measures.

Preferably, the anchoring jack further comprises a guiding member (33),

The guiding member (33) is disposed inside the cavity (29), and a gap (34) is formed inside the guiding member (33).

Preferably, the anchoring jack further comprises a second lock nut (32),

The other end of the anchor body (6) of the reclaimable sand-consolidated anchor head prestressed anchor provided by the present invention sequentially passes through the seventh through hole (26), the gap (34) and the eighth through hole (27) after leaving a remainder (30), the second lock nut (32) locks the second guide plate (28) and the remainder (30);

A pulling force can be applied through the remainder (30).

Preferably, the anchoring jack further comprises a tension rod (31), a second lock nut (32) and a tension connector (11).

After the tension rod (31) passes through the seventh through hole (26), the gap (34) and the eighth through hole (27), one end of the tension rod (31) passes through the tension connector (11) an external thread fixedly attached to the other end of the anchor body (6) of the reclaimable sand-consolidated anchor head prestressed anchor provided by the present invention, the second lock nut (32) locking The second guiding plate (28) is intended to be the other end of the tension bar (31);

The pulling force can be applied by the tension rod (31).

In order to achieve the above third object, the technical solution of the application method provided by the present invention is as follows:

The anchoring method for applying the reclaimable sand-consolidated anchor head prestressed anchor provided by the present invention comprises the following steps: Assembling the rigid frame (5), the pressure receiving member (4), the cut-off member (3) and the anchor pier (8);

The anchor body (6) is sequentially passed through the second through hole (15), the third through hole (16), the fourth through hole (17) and the fifth through hole (23) to obtain an anchor assembly;

Placing the anchoring assembly in the anchoring bore (7) and engaging the anchoring pier (8) to the exterior of the anchoring bore (7);

Applying a pulling force to the other end of the anchor body (6) such that the anchor pier (8), the rigid frame (5) and the pressure receiving member (4) jointly move toward the deep portion of the anchoring hole (7), Until the sand column (2) is crushed and forms a dense layer, such that the dense layer creates a large frictional force with one end surface of the anchor body (6);

Continue to apply a pulling force to the other end of the anchor body (6) until the dense layer reaches design criteria.

The method for recovering the recyclable sand-consolidated anchor head prestressed anchor provided by the present invention comprises the following steps:

Disassembling the pressure receiving member (4) and the cutoff member (3), Applying a pulling force to the anchor body (6);

Increasing the space between the pressure receiving member (4) and the deep portion of the anchoring bore (7);

As the space between the pressure receiving member (4) and the deep portion of the anchoring bore (7) continues to increase, the dense layer formed by the crushing of the sand column (2) becomes a loose sand layer, The friction between the loose sand layer and one end surface of the anchor body (6) is reduced;

Continue to apply a pulling force to the anchor body (6) until the recyclable sand-consolidated anchor head prestressed anchor provided by the present invention is completely recovered from the anchoring bore.

The application method provided by the present invention can be further implemented by the following technical measures.

Preferably,

The anchoring method using the retrievable sand-consolidated anchor head pre-stressed anchor further includes the step of locking the lock nut (10);

The method of recovering the retrievable sand-consolidated anchor head pre-stressed anchor further includes the step of disassembling the lock nut (10).

Preferably, the process of applying a pulling force to the other end of the anchor body (6) is achieved by the anchoring jack provided by the present invention.

In the case of the retrievable sand-consolidated anchor head prestressed anchor provided by the first embodiment of the present invention, when the reclaimable sand-consolidated anchor head pre-stressed anchor provided by the first embodiment of the present invention is applied for anchoring Since the distance between the pressure receiving member 4 and the anchor pier 8 has been fixed, the anchor body 6 is anchored to the borehole 7 along with the bearing member 4 in the process of being subjected to the force toward the deep portion of the anchoring borehole 7. Moving in the deep direction, when the load member 1 abuts against the bottom of the anchoring hole 7, the load member 1 applies a force to the sand column 2 toward the anchor pier 8, and the pressure member 4 and the cut-off member 3 jointly apply to the sand column 2. The force in the deep direction of the anchoring hole 7 is at this time, the sand column 2 is crushed by the force of the direction toward the anchor pier 8 and the force acting toward the deep part of the anchoring hole 7 to be crushed and crushed. The rear sand column 2 forms a dense layer, and forms a huge frictional force with the outer surface of the anchor body 6, which is pulled by the frictional force, and the combination between the cut-off member 3 and the pressure-bearing member 4 is closer, and the compactness is tight. The pressure exerted by the layer is also more stable. When it is required to recover the retrievable sand-consolidated anchor head pre-stressed anchor rod, the joint between the cut-off member 3 and the pressure-receiving member 4 can be opened by means of a tool, and once the cut-off member 3 is separated from the pressure-receiving member 4, it will be inherited. In the middle of the pressing member 4, a passage through which the first through hole 8 of the blocking member 3 is originally received is formed, and at this time, in the prestressed anchor of the reclaimable sand-consolidated anchor head provided by the embodiment 1 of the present invention The sand column 2 is made of coarse sand, and there is no adhesion between the coarse sand particles and the particles. In this case, the coarse sand particles which have formed the dense layer pass through the first through hole. The channel leaks, and as the coarse sand particles leak, the dense layer originally formed by the crushed sand column 2 begins to become loose, between the dense layer formed by the crushed sand column and the outer surface of the anchor body 6. The frictional force is reduced. At this time, a small pulling force toward the anchoring rod 8 is applied to the anchor body 6, and the bolt body 6 can be sequentially removed from the second through hole 15, the third through hole 16, and the fourth through hole. 17 and the fifth through hole 23 are extracted. At this time, by pulling the anchor pier 8, the rigid frame 5 and the pressure receiving member 4 can be jointly anchored. Take out the hole 7. Thereafter, if it is still necessary to recover the load member 1, the coarse sand particles in the crushed sand column need to be taken out to take out the exposed load member. It can be seen that the reclaimable sand-consolidated anchor head prestressed anchor provided by the first embodiment of the present invention can be used not only for anchoring the anchoring hole 7 but also when it is needed for recycling. The pre-stressed anchor rod of the recyclable sand-consolidated anchor head provided by the first embodiment of the invention can be recovered, which can reduce the cost and is more energy-saving and environmentally friendly.

BRIEF DESCRIPTION OF THE DRAWINGS

Various other advantages and benefits will become apparent to those skilled in the art from a The drawings are only for the purpose of illustrating the preferred embodiments and are not to be construed as limiting. Throughout the drawings, the same reference numerals are used to refer to the same parts. In the drawing.

DETAILED DESCRIPTION OF THE EMBODIMENTS

The invention solves the problems existing in the prior art, and provides a pre-stressed anchor rod for anchoring sand-consolidation anchor head, a jack for anchoring and an anchoring method, and after the anchoring is applied, the bolt body can be recovered and repeated. It is simpler to use and more environmentally friendly, making it more suitable for practical use.

In order to further illustrate the technical means and efficacy of the present invention for achieving the intended purpose of the invention, the reclaimed sand-consolidated anchor head prestressed anchor rod and anchoring according to the present invention will be described below with reference to the accompanying drawings and preferred embodiments. The specific embodiment, structure, characteristics and efficacy of the jack and anchoring method are described in detail later. In the following description, different "an embodiment" or "an embodiment" does not necessarily mean the same embodiment. Furthermore, the features, structures, or characteristics of one or more embodiments can be combined in any suitable form.

The term "and/or" in this context is merely an association that describes an associated object, indicating that there may be three relationships, for example, A and/or B. The specific understanding is that A and B can be included at the same time, and can be separate. If A exists, B may exist alone, and any of the above three cases may be provided.

Embodiment 1

Figure 1:
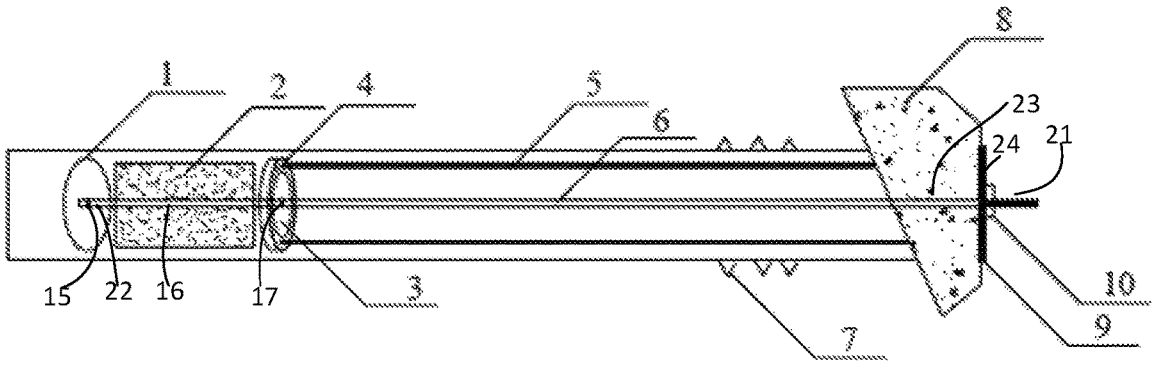
FIG. 1 is a schematic view showing the use state of a reclaimable sand-consolidated anchor head prestressed anchor according to Embodiment 1 of the present invention.

Referring to FIG. 1, a reclaimable sand-consolidated anchor head prestressed anchor provided by the first embodiment of the present invention includes a bolt body 6, a rigid frame 5, a load member 1, a sand column 2, a pressure receiving member 4, and a cut-off member 3. And anchor pier 8. One end of the rigid frame 5 is fixedly connected to one surface of the pressure receiving member 4, and the other end of the rigid frame 5 is fixedly coupled to one surface of the anchor pier 8. One surface of the pressure receiving member 4 corresponds to one surface of the anchor pier 8, so that The distance between the pressure receiving member 4 and the anchor pier 8 is fixed by the rigid frame 5. A first through hole 18 is defined in the center of the pressure receiving member 4, and the blocking member 3 can be accommodated in the first through hole 18, and the blocking member 3 can only move in one direction along the axial direction of the pressure receiving member 4, this embodiment The cut-off member 3 can only reciprocate at a distance between the pressure receiving member 4 and the anchor pier 8 and cannot reciprocate between the load member 1 and the pressure receiving member 4 over the pressure receiving member 4, and the center of the load member 1 is opened. The second through hole 15 defines a third through hole 16 in the center of the sanding member 2, and a fourth through hole 17 is defined in the center of the blocking member 3. The fifth through hole 23 is opened in the center of the anchoring hole 8. The third through hole 16, the fourth through hole 17, and the fifth through hole 23 are concentric. The anchor body 6 can sequentially form a sliding pair with the second through hole 15, the third through hole 16, the fourth through hole 17, and the outer wall of the fifth through hole 23. The diameters of the load member 1, the sand column 2, the pressure receiving member 4, and the rigid frame 5 are all equivalent to the diameter of the anchoring borehole 7, and the radial dimension of the anchoring pier 8 is larger than the diameter of the anchoring borehole 7. One end 22 of the anchor body 6 is a polished rod. After the bolt body 6 is sequentially passed through the second through hole 15, the third through hole 16, the fourth through hole 17 and the fifth through hole 23 through the polished rod, the anchor body 6 The other end extends from the fifth through hole 23.

In the case of the retrievable sand-consolidated anchor head prestressed anchor provided by the first embodiment of the present invention, when the reclaimable sand-consolidated anchor head pre-stressed anchor provided by the first embodiment of the present invention is applied for anchoring First, the load member 1 is placed in the deep part of the anchoring drill hole 7, and the coarse sand is poured into the anchoring hole 7 to form the sand column 2, and then the recyclable sand-consolidated anchor head provided in the first embodiment of the present invention is combined. The prestressed anchor is placed in the anchoring hole 7. At this time, since there is no bonding force between the coarse sand particles, the anchor body 6 can easily pass through the sand column 2, and the load member 1 The diameters of the pressing member 4 and the rigid frame 5 are both equal to the diameter of the anchoring drill hole 7, so that when the anchor body 6 extends into the deep portion of the anchoring hole 7, it can be connected to the second through hole at the center of the load member 1. 15 pairs, therefore, the bolt body 6 can pass through the second through hole 15 and be rooted in the deep portion of the anchoring hole 7. Thereafter, since the distance between the pressure receiving member 4 and the anchor pier 8 has been fixed, the anchor body 6 is anchored to the anchor hole 7 along with the bearing member 4 in the process of being subjected to the force toward the deep portion of the anchoring hole 7. The deep direction moves. When the load member 1 abuts against the bottom of the anchor hole 7, the load member 1 applies a force toward the sand column 2 toward the anchor pier 8. The pressure member 4 and the cutoff member 3 are common toward the sand column 2. Applying a force toward the deep direction of the anchoring hole 7, at this time, the sand column 2 is crushed by the force of the direction toward the anchor pier 8 and the force acting toward the deep portion of the anchoring hole 7 to be crushed and pressed. The crushed sand column 2 forms a dense layer, and forms a huge frictional force with the outer surface of the anchor body 6, and is pulled by the frictional force, and the joint between the cut-off member 3 and the pressure-bearing member 4 is more tight, The pressure exerted by the dense layer is also more stable. When it is required to recover the retrievable sand-consolidated anchor head pre-stressed anchor rod, the joint between the cut-off member 3 and the pressure-receiving member 4 can be opened by means of a tool, and once the cut-off member 3 is separated from the pressure-receiving member 4, it will be inherited. In the middle of the pressing member 4, a passage through which the first through hole 8 of the blocking member 3 is originally received is formed, and at this time, in the prestressed anchor of the reclaimable sand-consolidated anchor head provided by the embodiment 1 of the present invention The sand column 2 is made by injecting coarse sand, and there is no adhesion between the coarse sand particles and the particles. In this case, the coarse sand particles which have formed the dense layer pass through the first through hole 18 as a passage. The channel leaks, and as the coarse sand particles leak, the dense layer originally formed by the crushed sand column 2 begins to become loose, between the dense layer formed by the crushed sand column and the outer surface of the anchor body 6. The frictional force is reduced. At this time, a small pulling force toward the anchoring rod 8 is applied to the anchor body 6, and the bolt body 6 can be sequentially taken out from the second through hole 15, the third through hole 16, and the fourth through. The hole 17 and the fifth through hole 23 are extracted. At this time, by pulling the anchor pier 8, the rigid frame 5 and the pressure receiving member 4 can be connected together. 7, the solid-drilling. Thereafter, if it is still necessary to recover the load member 1, the coarse sand particles in the crushed sand column 2 need to be taken out to take out the exposed load member 1. It can be seen that the reclaimable sand-consolidated anchor head prestressed anchor provided by the first embodiment of the present invention can be used not only for anchoring the anchoring hole 7 but also when it is needed for recycling. The prestressed anchor rod of the recyclable sand-consolidated anchor head provided by the first embodiment of the invention can be recovered, which can reduce the cost and is more energy-saving and environmentally friendly.

Wherein, the retrievable sand-consolidated anchor head pre-stressed anchor bar may further comprise a carrier plate 9. The center of the carrier plate 9 is provided with a sixth through hole 24, and the anchor body 6 can form a sliding pair with the inner wall of the sixth through hole 24. After the anchor body 6 is sequentially inserted through the optical rods through the second through holes 15, the third through holes 16, the fourth through holes 17, the fifth through holes 23, and the sixth through holes 24, the other end of the anchor body 6 is The fifth through hole 23 is extended. In this case, since the area of the carrier plate 9 is large, the anchor pier 8 is fixed by applying a force to the carrier plate 9, so that the pressure applied to the anchor pier 8 can be prevented from being excessively damaged, and the anchoring effect can be affected.

Wherein, the retrievable sand-consolidated anchor head pre-stressed anchor further comprises a first lock nut 10. The other end 21 of the bolt body 6 is provided with an external thread, and the first lock nut 10 can lock the external thread. In this case, since the threaded pair is formed by the external thread provided on the other end 21 of the anchor body 6 with the lock nut 10, the process of applying a force toward the sand column 2 toward the deep portion of the anchor hole 7 can be avoided. The middle bolt body 6 slides out.

Wherein, one end 22 of the anchor body 6 may be provided with a damping member. In this case, since the damper can increase the friction between the anchor body 6 and the inner walls of the second through hole 15, the fourth through hole 17, and the fifth through hole 23, it is possible to avoid implementing the present invention. The recyclable sand-consolidated anchor head pre-stressed anchors that have been provided have been laid out during the process of being placed in the anchoring borehole 7.

A damping member may be disposed on the inner walls of the second through hole 15, the third through hole 16, the fourth through hole 17, and the fifth through hole 23. In this case, since the damper can increase the friction between the anchor body 6 and the second through hole 15, the third through hole 16, the fourth through hole 17, and the inner wall of the fifth through hole 23, It is avoided that the recyclable sand-consolidated anchor head pre-stressed anchors that have been provided by the embodiments of the present invention are scattered during the process of being placed in the anchoring borehole 7.

The inner wall of the sixth through hole 24 may be provided with a damping member. In this case, since the damper can increase the friction between the anchor body 6 and the inner walls of the second through hole 15, the fourth through hole 17, and the fifth through hole 23, it is possible to avoid implementing the present invention. The recyclable sand-consolidated anchor head pre-stressed anchors that have been provided have been laid out during the process of being placed in the anchoring borehole 7.

The load member 1, the cut-off member 3 and the anchor body 6 may each have magnetic properties, wherein the magnetic poles of the load member 1 and the cut-off member 3 are the same, and the magnetic poles of the anchor body 6 are opposite to the magnetic poles of the load member 1 and the cut-off member 3. In this case, the load member 1, the cut-off member 3 and the anchor body 6 can be temporarily formed into a tight bond by magnetic attraction, and therefore, the recyclable sand-consolidated anchor head which has been provided in the embodiment of the present invention can be avoided. The prestressed anchors are scattered during the insertion of the anchoring holes 7. In addition, since the force provided by the magnetic attraction is relatively small, in the process of recovering the reclaimable sand-consolidated anchor head prestressed anchor provided in the first embodiment of the present invention, the anchor body 6 is not required. It adds a lot of pulling force, so it is a simple and effective combination.

Figure 3:
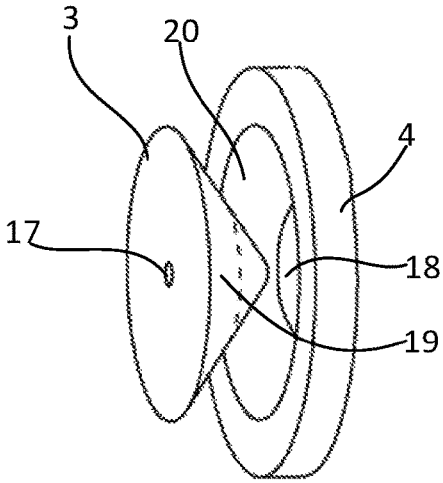
FIG. 3 is an exploded view of a pressure-receiving member and a cut-off member applied to a pre-stressed anchor of a reclaimable sand-consolidated anchor head according to Embodiment 1 of the present invention.

Referring to FIG. 3, the first through hole 18 may be a tapered hole having a diameter smaller toward one end of the anchor body 6 than a diameter of the tapered hole toward the other end of the anchor body 6. The shutoff member 3 can be tapered, and the outer tapered surface 19 of the cutoff member 3 is in full contact with the inner tapered surface 20 of the tapered bore. In this case, since the diameter of the tapered end toward the deep end of the anchoring bore 7 is smaller than the diameter of the end facing the anchor pier 8, it is possible to ensure that the cut-off member 3 can only be in the bearing member 4 and the anchor pier 8. The distance between them reciprocates and cannot reciprocate between the load member 1 and the pressure receiving member 4 over the pressure receiving member 4.

A damping member may be disposed on both the outer tapered surface 19 and the inner tapered surface 20. In this case, the damper member can form a relatively stable joint between the outer tapered surface 19 and the inner tapered surface 20, and at the same time, the damper member can form an isolation layer between the outer tapered surface 19 and the inner tapered surface 20. It is possible to avoid the dilemma that the cut-off member 3 and the pressure-receiving member 4 are eroded together after a long period of close bonding, resulting in difficulty in disassembling each other.

Wherein, the damping member can be made of a material that is deformed by pressure. In this case, since the damper member is deformed by pressure, the bonding force can be made stronger, and therefore, when the damper member is made of a material having a pressure variability, the damper member can be formed after being deformed. For the tight combination, in the process of disassembly, the pull force is not increased much. In this embodiment, the pressure-deformable material may be rubber or latex.

Wherein, both the pressure receiving member 4 and the cutoff member 3 may have magnetic properties and opposite magnetic properties. In this case, a tight bond can be temporarily formed between the pressure receiving member 4 and the cut-off member 3 by magnetic attraction, and therefore, the reconstitutable anchor of the recyclable sand-consolidated anchor head which has been provided by the embodiment of the present invention can be avoided. The rack is scattered during the process of being placed in the anchoring hole 7. In addition, since the force provided by the magnetic attraction is relatively small, in the process of recovering the reclaimable sand-consolidated anchor head prestressed anchor provided in the first embodiment of the present invention, the pressure-receiving member is not required. 4 exerts a very large dismantling force with the cut-off piece 3, so it is a simple and effective combination.

Embodiment 2

Figure 2:
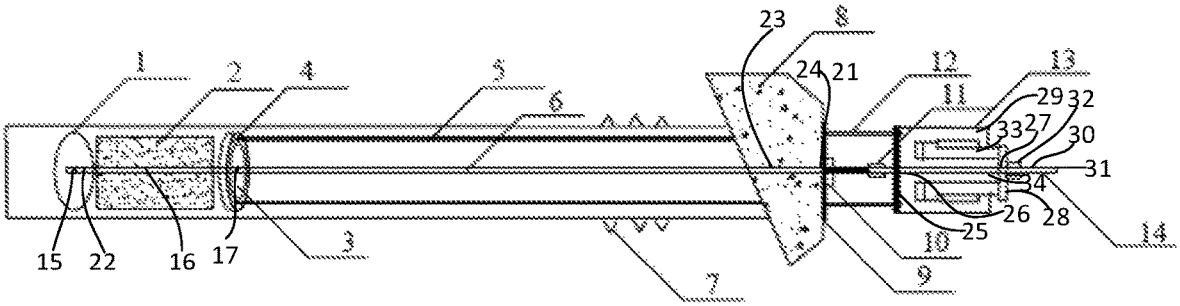
FIG. 2 is a schematic view showing the use state of the anchoring jack provided in the second embodiment of the present invention and the pre-stressed anchor rod of the recyclable sand-consolidated anchor head provided by the first embodiment of the present invention.

Referring to FIG. 2, the anchor for anchoring provided by the second embodiment of the present invention includes a force transmitting frame 12, a first guiding plate 25, a second guiding plate 28 and a casing 13. One end of the force-transmitting frame 12 is fixedly connected to the first guiding plate 25, and the other end of the force-transmitting frame 12 is used to abut the anchor pier 8 of the reclaimable sand-consolidated anchor head pre-stressed anchor provided by the first embodiment of the present invention or The carrier plate 9 of the pre-stressed anchor of the retrievable sand-consolidated anchor head provided by the first embodiment of the present invention. The center of the first guiding plate 25 is provided with a seventh through hole 26, and the center of the second guiding plate 28 is provided with an eighth through hole 27, and the seventh through hole 26 and the eighth through hole 27 are respectively connected with the second through hole 15, The three-way hole 16, the fourth through hole 17, and the fifth through hole 23 are concentric. One end of the housing 13 is fixedly connected to the first guiding plate 25 by its edge, and the other end of the housing 13 is fixedly connected to the second guiding plate 28 through its edge, the first guiding plate 25, the second guiding plate 28 and the housing. A cavity 29 is formed between 13.

In this case, due to the introduction of the anchor jack provided by the second embodiment of the present invention, the pulling force can be applied to the anchor body 6 more conveniently. At this time, the pulling force can be applied to the bolt body 6 in two ways:

In the first way, the anchoring jack can also include a second lock nut 32. The retractable sand-consolidated anchor head prestressed anchor provided by the present invention applies the remaining end 30 through the seventh through hole 26, the gap 34 and the eighth through hole 27, and the remaining end 30 is left. The lock nut 32 locks the second guide plate 28 and the remainder 30. The pulling force can be applied through the remainder 30.

The second way is that the anchoring jack can also include a tension rod 31, a second lock nut 32, and a tension connector 11. After the tension rod 31 passes through the seventh through hole 26, the gap 34 and the eighth through hole 27, one end of the tension rod 31 is fixedly connected to the recyclable sand-consolidated anchor head prestressed anchor provided by the present invention through the tension connector 11. The external thread on the other end of the bolt body 6 to which the rod is applied, the second lock nut 32 locks the other end of the second guide plate 28 to be pulled up. The pulling force can be applied by the tension rod 31.

Wherein, the anchoring jack may further include a guiding member 33. The guide member 33 is disposed inside the cavity 29 to form a gap 34 inside the guide member 33. In this case, the insertion of the anchor body 6 or the tension rod 31 between the seventh through hole 26 and the eighth through hole 27 is facilitated, and interference between the guide member 33 and the anchor body 6 can also be avoided. In addition, the guide member 33 is in thread contact with the housing 13 and constitutes a thread pair. By rotating the guide member 33, the force can be transmitted by the thread pair, that is, the rotation force is converted into the bolt body 6 by the thread pair. The linear force. In this embodiment, as the guide member 33 rotates clockwise relative to the housing 13, the guide member 33 can be caused to move the anchor body 6 in a direction away from the anchor pier 8; with the guide member 33 relative to the housing The rotation in the counterclockwise direction 13 enables the guide member 33 to move the anchor body toward the anchor pier 8, in which case the length of the arm can be increased, and therefore, the push applied to the bolt body 6 can be caused. Both the pressure and the pulling force are reduced, that is, the bolt body 6 can be pushed or pulled with a small force.

Embodiment 3

Figure 4:
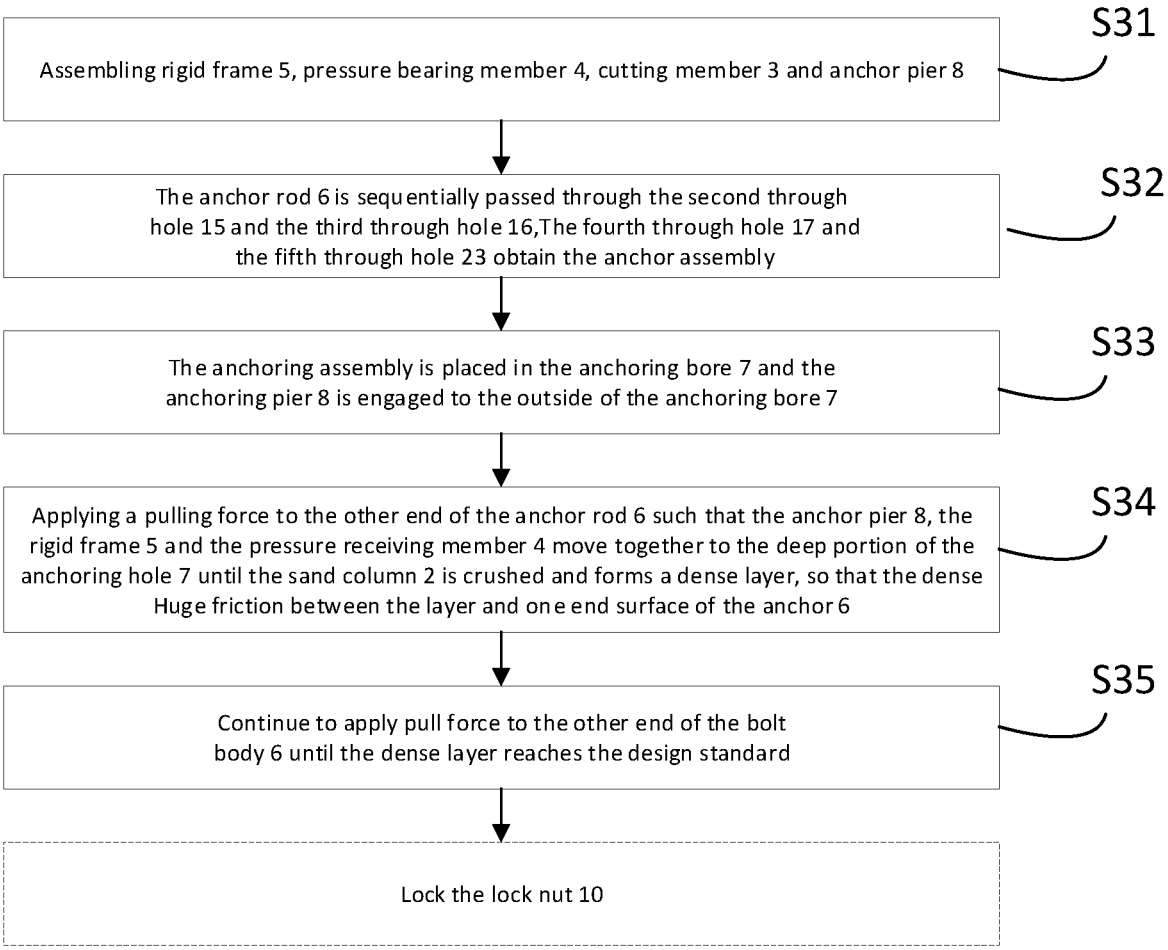
FIG. 4 is a flow chart showing the steps of an anchoring method for applying a reclaimable sand-consolidated anchor head prestressed anchor rod according to Embodiment 1 of the present invention.

Referring to FIG. 4, an anchoring method for applying a retrievable sand-consolidated anchor head prestressed anchor provided by Embodiment 1 of the present invention includes the following steps:

Step S31: assembling the rigid frame 5, the pressure receiving member 4, the cutting member 3 and the anchor pier 8;

Step S32: The anchor body 6 is sequentially passed through the second through hole 15, the third through hole 16, the fourth through hole 17, and the fifth through hole 23 to obtain an anchor assembly;

Step S33: placing the anchoring assembly in the anchoring hole 7 and causing the anchoring pier 8 to be engaged with the outside of the anchoring hole 7;

Step S34: applying a pulling force to the other end of the anchor body 6 such that the anchor pier 8, the rigid frame 5 and the pressure bearing member 4 jointly move toward the deep portion of the anchoring hole 7 until the sand column 2 is crushed and forms a dense layer. So that a dense frictional force is generated between the dense layer and one end surface of the anchor body 6;

Step S35: Continue to apply a pulling force to the other end of the anchor body 6 until the dense layer reaches the design standard.

In the process of applying the reclaimable sand-consolidated anchor head prestressed anchor provided in the first embodiment of the present invention, since the distance between the pressure receiving member 4 and the anchor pier 8 has been fixed, the anchor body 6 is subjected to In the process of moving toward the deep part of the anchoring hole 7, the bearing member 1 is moved toward the bottom of the anchoring hole 7 together with the bearing member 4, and when the load member 1 is pressed against the bottom of the anchoring hole 7, the load member 1 is sanded. The column 2 exerts a force in the direction of the anchor pier 8, and the pressure member 4 and the cut-off member 3 collectively apply a force toward the sand column 2 toward the deep direction of the anchor hole 7, at which time the sand column 2 is simultaneously subjected to the anchor pier 8 The force of the direction and the force of the force acting toward the deep portion of the anchoring hole 7 are crushed, and the crushed sand column 2 forms a dense layer, forming a large frictional force with the outer surface of the bolt body 6. By the pulling of the frictional force, the joint between the cut-off member 3 and the pressure receiving member 4 is more tight, and the pressure applied to the dense layer is also more stable.

Wherein, when the lock nut 10 is provided, the anchoring method using the retrievable sand-consolidated anchor head pre-stressed anchor may further include the step of locking the lock nut 10.

The process of applying the pulling force to the other end of the anchor body 6 during the anchoring method of the reclaimable sand-consolidated anchor head prestressed anchor provided by the first embodiment of the present invention provided by the third embodiment of the present invention It can be realized by the anchoring jack provided in the second embodiment of the present invention.

Embodiment 4

Figure 5:
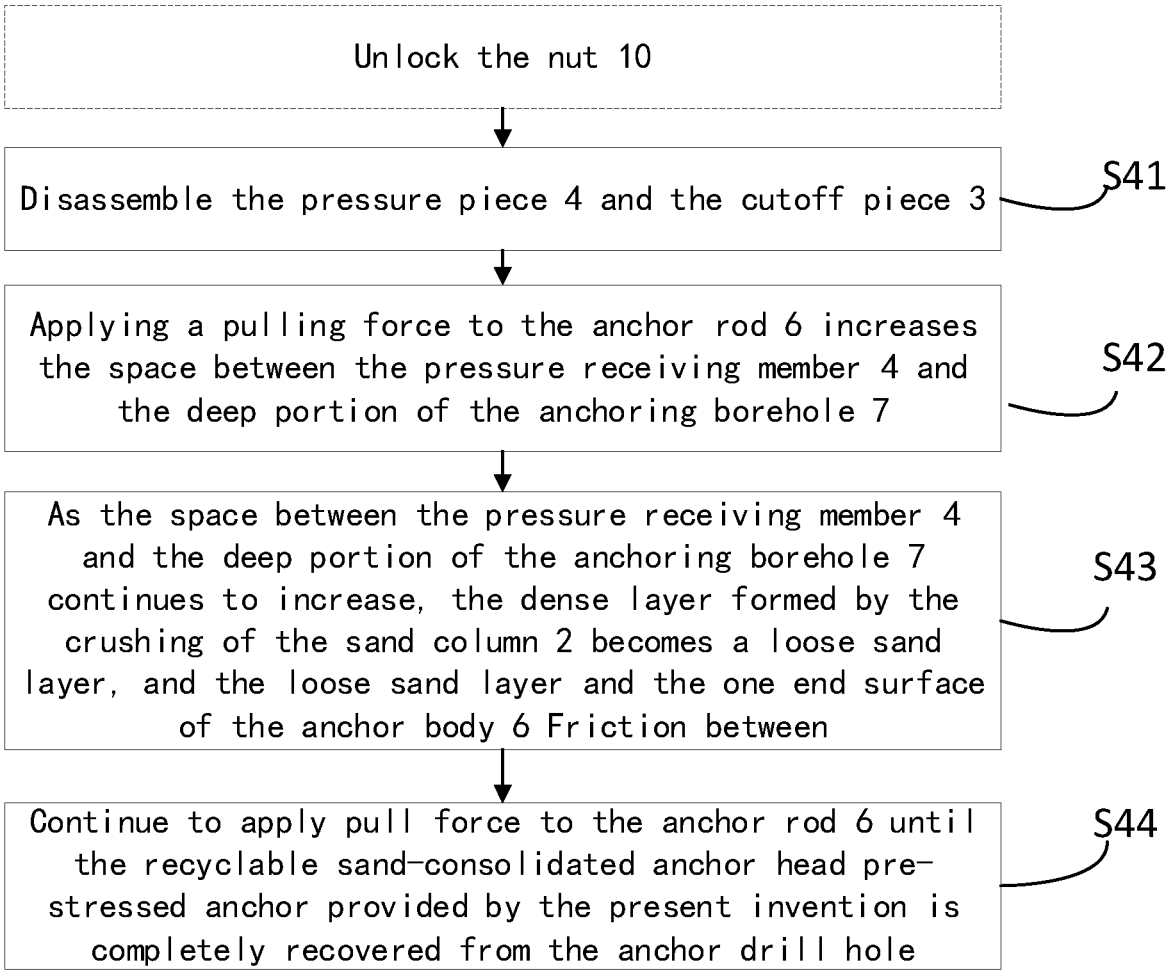
FIG. 5 is a flow chart showing the steps of a method for recovering a reclaimable sand-consolidated anchor head pre-stressed anchor provided by the first embodiment of the present invention.

Referring to FIG. 5, a method for recovering a retrievable sand-consolidated anchor head prestressed anchor provided in Embodiment 1 of the present invention comprises the following steps:

Step S41: disassembling the pressure receiving member 4 and the cutting member 3;

Step S42: applying a pulling force to the anchor body 6, so that the space between the pressure receiving member 4 and the deep portion of the anchoring hole 7 is increased;

Step S43: As the space between the pressure receiving member 4 and the deep portion of the anchoring borehole 7 continues to increase, the dense layer formed by the crushing of the sand column 2 becomes a loose sand layer, and the loose sand layer and the anchor body 6 The friction between the surfaces of one end is reduced;

Step S44: Continue to apply the pulling force to the anchor body 6 until the recyclable sand-consolidated anchor head pre-stressed anchor provided by the present invention is completely recovered from the anchoring bore.

When it is required to recover the retrievable sand-consolidated anchor head pre-stressed anchor rod, the joint between the cut-off member 3 and the pressure-receiving member 4 can be opened by means of a tool, and once the cut-off member 3 is detached from the pressure-receiving member 4, it will be under pressure. In the middle of the piece 4, a passage is formed which is a passage through the first through hole 8 which originally accommodates the cut-off member 3. At this time, the sand in the pre-stressed anchor of the recyclable sand-consolidated anchor head provided by the embodiment 1 of the present invention is provided. Column 2 is made of coarse sand, and there is no adhesion between the coarse sand particles and the particles. In this case, the coarse sand particles which have formed the dense layer pass through the passage through the first through hole. Leakage, as the coarse sand particles leak, the dense layer originally formed by the crushed sand column 2 begins to become loose, and the friction between the dense layer formed by the crushed sand column and the outer surface of the anchor body 6 The force is reduced. At this time, a small pulling force toward the anchor body 8 is applied to the anchor body 6, so that the bolt body 6 can be sequentially removed from the second through hole 15, the third through hole 16, and the fourth through hole 17 And pulling out the fifth through hole 23, at this time, by pulling the anchor pier 8, the rigid frame 5 and the pressure bearing member 4 can be jointly pulled from the anchor drill Take out the hole 7. Thereafter, if it is still necessary to recover the load member 1, the coarse sand particles in the crushed sand column need to be taken out to take out the exposed load member.

Wherein, when the lock nut 10 is present, the method of recovering the retrievable sand-consolidated anchor head pre-stressed anchor may further include the step of disassembling and unlocking the nut 10.

The process of applying the pulling force to the other end of the anchor body 6 during the method for recovering the reclaimable sand-bonded anchor head pre-stressed anchor provided by the first embodiment of the present invention is provided in the fourth embodiment of the present invention. The anchoring jack provided by the second embodiment of the present invention is realized.

While the preferred embodiment of the invention has been described, it will be understood that Therefore, the appended claims are intended to be interpreted as including the preferred embodiments and the modifications and It is apparent that those skilled in the art can make various modifications and variations to the invention without departing from the spirit and scope of the invention. Thus, it is intended that the present invention cover the modifications and modifications of the invention.

The invention claimed is:

1. A recyclable anchor, comprising: a bolt body (6), a rigid frame (5), a load member (1), a sand column (2), a pressure bearing member (4), a cut-off piece (3) and an anchor pier (8), wherein one end of the rigid frame (5) is fixedly connected to the pressure bearing member (4), and the other end of the rigid frame (5) is fixedly connected to the anchor pier (8);

a first through hole (18) placed in a center of the pressure bearing member (4), the cutoff member (3) in the first through hole (18), is configured to move in one direction along the axial direction of the pressure bearing receiving member (4); and the anchor body (6) is configured to sequentially slide with the outer walls of a second through hole (15), a third through hole (16), a fourth through hole (17), and a fifth through hole (23) in the center of the load member (1), wherein the load-bearing member (1), the cut-off piece (3) and the bolt body (6) are magnetic and the magnetic poles of the load-bearing member (1) are the same as those of the cut-off piece member (3), and the magnetic poles of the bolt body (6) are opposite to those of the load-bearing member (1) and the stop member (3).

2. The recyclable anchor according to claim 1, further comprising a carrier plate (9), wherein the center of the carrier plate (9) is provided with a sixth through hole (24), the anchor body (6) can form a sliding pair with the inner wall of the sixth through hole (24); and when the anchor body (6) is sequentially passed through the light rod, the second through hole (15), the third through hole (16), the fourth through hole (17), and the fifth through hole (23) And after the sixth through hole (24), the other end of the anchor body (6) protrudes from the fifth through hole (23).

3. The recyclable anchor according to claim 1, further comprising a first lock nut (10), wherein the other end (21) of the anchor body (6) is provided with an external thread, and the first lock nut (10) is capable of locking the external thread.

4. The recyclable anchor according to claim 1, wherein the one end (22) of the anchor body (6) is provided with a damping member.

5. The recyclable anchor according to claim 1, wherein the second through hole (15), the fourth through hole (17), and the fifth through hole (23) are provided on an inner wall of the retrievable anchor.

* * * * *